US008316920B2

(12) United States Patent
Otsuka et al.

(10) Patent No.: US 8,316,920 B2
(45) Date of Patent: Nov. 27, 2012

(54) BRUSH ROLL FOR CASTING ROLL

(75) Inventors: Hiroyuki Otsuka, Tokyo (JP); Hiroki Yoshizawa, Tokyo (JP); Katsumi Nakayama, Tokyo (JP); Kazuo Miyoshi, Tokyo (JP)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 12/623,358

(22) Filed: Nov. 20, 2009

(65) Prior Publication Data

US 2010/0236747 A1 Sep. 23, 2010

(30) Foreign Application Priority Data

Nov. 20, 2008 (JP) ..... 2008-296794
Nov. 20, 2008 (JP) ..... 2008-296795

(51) Int. Cl.
*B22D 11/06* (2006.01)
*A46B 3/00* (2006.01)
*A46B 7/00* (2006.01)

(52) U.S. Cl. .... 164/480; 164/428; 15/256.5; 15/256.51; 15/256.52

(58) Field of Classification Search ..... 164/428, 164/480; 15/262.51, 262.52, 256.5
See application file for complete search history.

(56) References Cited

U.S. PATENT DOCUMENTS 3,744,080 A * 7/1973 Smith, Jr. ..... 15/256.51
3,795,025 A 3/1974 Sadamitsu
4,530,597 A 7/1985 Itaya et al.
4,793,400 A * 12/1988 Wood ..... 164/121
5,307,861 A * 5/1994 Townsend ..... 164/428
5,575,327 A * 11/1996 Kato ..... 164/158
5,964,277 A 10/1999 Tanaka et al.
6,886,623 B2 * 5/2005 Kato et al. ..... 164/480
7,296,614 B2 * 11/2007 Schlichting et al. ..... 164/480
2007/0033751 A1 2/2007 Hof et al.
2008/0244852 A1 10/2008 Alton

FOREIGN PATENT DOCUMENTS

EP 0461898 4/1996
JP 03-118944 5/1991
JP 03-230849 10/1991

(Continued)

OTHER PUBLICATIONS

English translation of Japanese Patent No. 07-276001.

*Primary Examiner* — Devang R Patel
(74) *Attorney, Agent, or Firm* — Hahn, Loeser & Parks, LLP; Arland T. Stein

(57) ABSTRACT

A metal strip casting apparatus and method of casting metal strip include assembling a pair of counter-rotatable casting rolls positioned laterally forming a nip between for casting, and assembling a pair of brush rolls, each of the brush rolls associated with one of each of the casting rolls. Each brush roll includes at least one spaced apart brush line extending substantially along the axial length of the casting roll. The brush lines may form a spiral, zigzag, wave or crisscross array about the brush roll. The brush roll may include one or more staggered rings with regularly or irregularly spaced apart bristles which form the brush lines. The brush lines may be between 10 to 50 mm apart and separated by between 2 mm to 45 mm of open space. The brush lines may be one line per 10 mm to 90 mm of axial length of brush roll.

18 Claims, 4 Drawing Sheets

FOREIGN PATENT DOCUMENTS

| | | |
|---|---|---|
| JP | 04-066247 | 3/1992 |
| JP | 05-177311 | 7/1993 |
| JP | 05-277010 | 10/1993 |
| JP | 06-200388 | 7/1994 |
| JP | 07-276001 | 10/1995 |
| JP | 09-029393 | 2/1997 |
| JP | 09-029394 | 2/1997 |
| JP | 2002-210544 | 7/2002 |
| JP | 2007-050120 | 3/2007 |
| WO | 2008-082160 | 7/2008 |

* cited by examiner

BRUSH ROLL FOR CASTING ROLL

CROSS-REFERENCE TO RELATED APPLICATIONS

This application claims the benefit of Japanese Application No. 2008-296794 and Japanese Application No. 2008-296795, both filed Nov. 20, 2008, the disclosures of which are both incorporated herein by reference.

BACKGROUND AND SUMMARY

This invention relates in general to making thin strip and more particularly casting of thin strip by a twin roll caster.

It is known to cast metal strip by continuous casting in a twin roll caster. Molten metal is introduced between a pair of counter-rotating horizontal casting rolls which are cooled so that metal shells solidify on the moving roll surfaces, and are brought together at the nip between them to produce a solidified strip product delivered downwardly from the nip between the rolls. The term "nip" is used herein to refer to the general region at which the rolls are closest together. The molten metal may be poured from a ladle into a smaller vessel or tundish/distributor, from which it flows through a metal delivery nozzle located above the nip, which directs the molten metal to form a casting pool supported on the casting surfaces of the rolls above the nip. This casting pool is typically confined at the ends of the casting rolls by side plates or dams held in sliding engagement adjacent the ends of the casting rolls.

In casting thin strip by twin roll casting, a brush is provided to clean debris from each of the casting rolls, such as accumulation of metal oxides and slags or other contaminants on the roll surfaces. During casting the surfaces of the casting rolls are continuously cleaned ahead of contacting the molten metal in the casting pool.

For example Japanese Patent Publication JP 3230849-A by Nippon Steel Corporation and Mitsubishi Heavy Industries KK discloses two sets of divided roller brushes applied to the surfaces of chilled casting rolls with the brushes of one set being staggered with respect to those of the other set to provide brushing action across the complete width of the casting roll. Japanese Patent Publication JP 01083341-A also by Nippon Steel Corporation and Mitsubishi Heavy Industries KK also discloses a twin roll caster in which the casting rolls are cleaned by brushes. Further, Japanese Patent Applications 29393/97 and 29394/97 for Nippon Steel Corporation disclose roll cleaning arrangements in which two cylindrical cleaning brushes are brought successively into contact with a casting roll at different stages of a casting run. Additionally, U.S. Pat. No. 4,793,400 discloses a casting drum cleaner in which a pair of similar rotating brushes are applied in tandem to the drum, both brushes being driven in opposite directions to the rotation of the drum. Other roll brushing arrangements are disclosed in our U.S. Pat. Nos. 5,307,861 and 5,575,327.

Previously, various designs have been proposed for cleaning brushes, with a variety of bristle patterns. Examples of cleaning brushes are disclosed in Japanese Patent Publication No. JP 03-118944 and European Patent No. 0461898.

The present invention provides an improved apparatus for casting metal strip and method of continuously casting metal strip. Disclosed is a method for casting metal strip comprising:

(a) assembling a pair of casting rolls laterally disposed to form a nip between them, (b) assembling a pair of brush rolls with one of each of the brush rolls associated with one of each of the casting rolls, each brush roll including at least one spaced apart brush line extending substantially along the axial length of the casting roll, (c) introducing molten metal to form a casting pool of molten metal supported on the casting rolls above the nip, and (d) counter rotating the casting rolls to deliver cast strip downwardly from the nip and rotating the brush rolls to clean the casting rolls.

The brush roll may include one or more brush lines. Each brush line may form a spiral array along the brush roll. Alternatively, the brush lines may form other desired geometric arrays such as zigzags, waves, and crisscrosses. In any case, the brush lines may be 10 mm to 50 mm apart separated by open space of 2 mm to 45 mm. The brush lines may set at one line per 10 mm to 90 mm of axial length of brush roll.

The brush roll may include one or more rings including spaced apart bristles to form the brush lines. The bristles may be regularly or irregularly spaced apart in the rings. The brush roll may include a plurality of rings staggered about the brush roll.

Various aspects of the invention will be apparent from the following detailed description, drawings, and claims.

BRIEF DESCRIPTION OF THE DRAWINGS

The invention is described in more detail in reference to the accompanying drawings in which.

DETAILED DESCRIPTION

Figure 1:
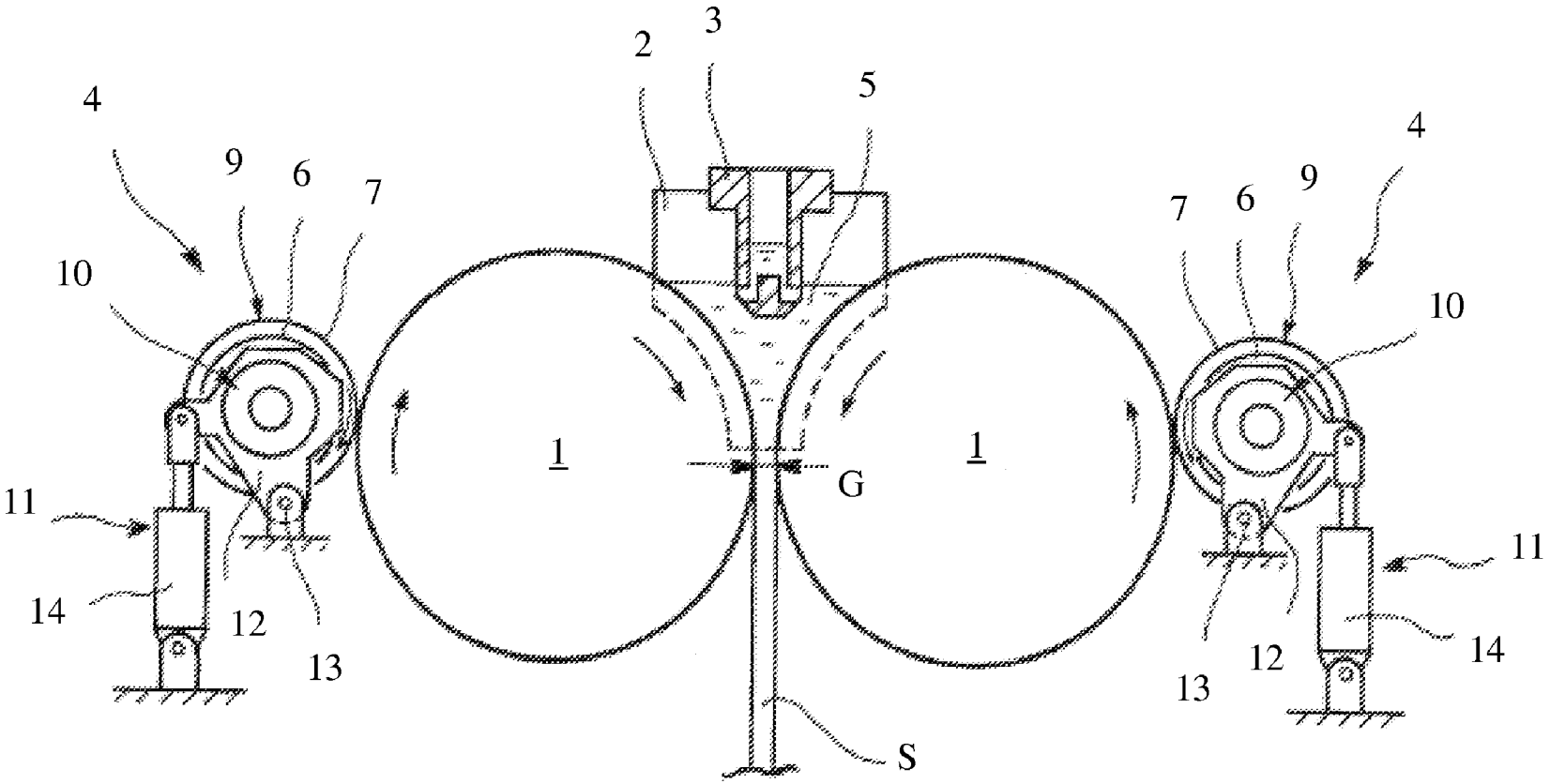
FIG. 1 illustrates a cross-sectional end view of a portion of twin roll strip caster.

Referring to FIG. 1, the metal strip casting apparatus includes a metal delivery nozzle 3 formed in segments located below a metal distributor, not shown, (also called a moveable tundish or transition piece) and above casting rolls 1. Casting rolls 1 are laterally positioned with nip G formed between them. The metal distributor receives metal from a ladle through a metal delivery system, not shown, and delivers the molten metal to delivery nozzle 3. A shroud, not shown, may extend from the metal distributor and into delivery nozzle 3, for the purpose of transferring molten metal into the segments of delivery nozzle 3. In the alternative, the metal distributor may transfer metal to the segments of delivery nozzle 3 via a hole in the bottom of the metal distributor. Below delivery nozzle 3, a casting pool 5 with a meniscus surface is formed supported on the casting surfaces of casting rolls 1 adjacent nip G. Casting pool 5 is constrained at the ends of the casting rolls by side dams or plates 2 positioned against the sides of the casting rolls. The segments of the delivery nozzle 3 control molten metal flow into casting pool 5. Generally, segments of the delivery nozzle 3 extend into and are partially submerged in casting pool 5 during the casting campaign.

Also shown in FIG. 1 is a pair of roll cleaning devices 4 each including a brush roll 9. Each brush roll 9 includes at least one brush line 7 on a barrel 6. Each brush roll 9 is mounted with a rotary drive 10 in a bracket 12, which is pivotably mounted at hinge 13. A force control mechanism 11, including an actuator 14 is connected to the bracket 12 for selective application of the brush roll 9 to the casting roll 1 about the hinge 13.

Figure 2:
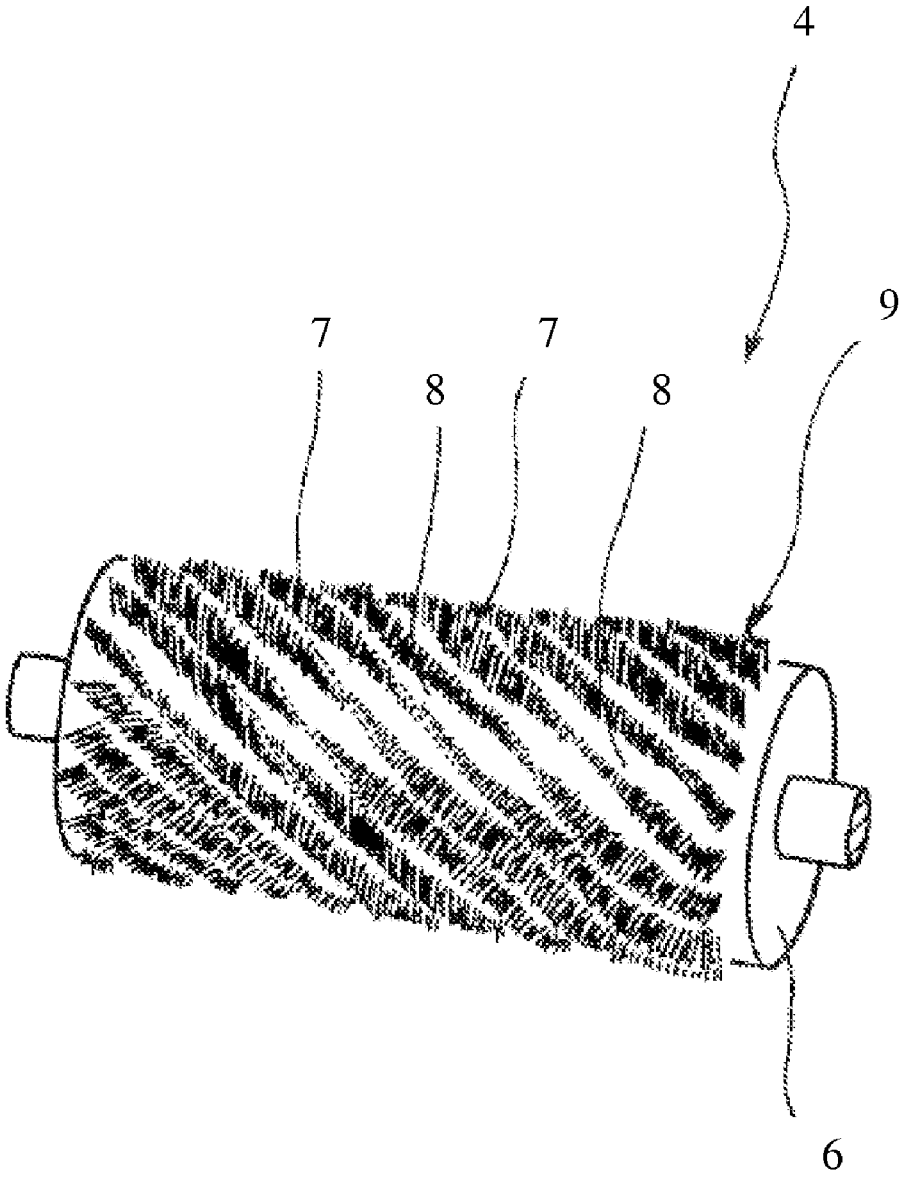
FIG. 2 shows an enlarged perspective view of the brush roll of FIG. 1.
Figure 3:
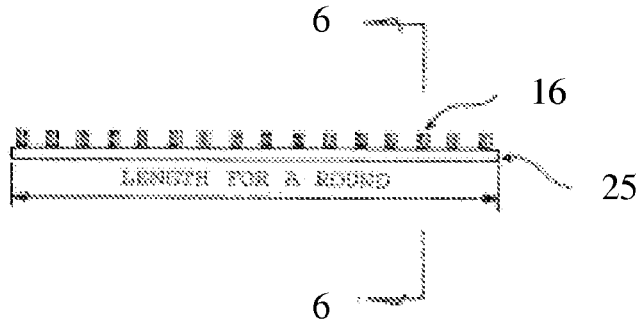
FIG. 3 illustrates a channel and bristles for a ring of the brush roll of FIG. 2.
Figure 4:
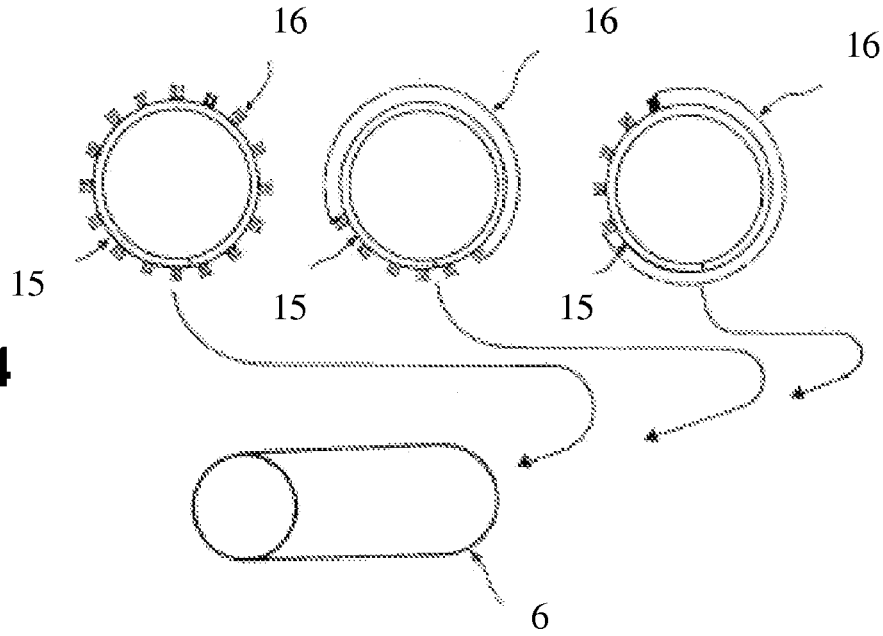
FIG. 4 illustrates a plurality of staggered rings being placed upon a barrel to form a brush roll.
Figure 5:
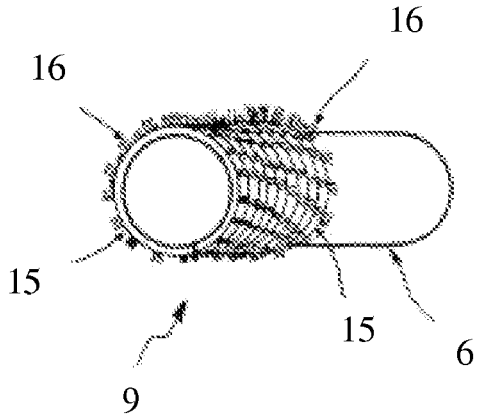
FIG. 5 shows a partially completed brush roll including the staggered rings of FIG. 4.
Figure 6:
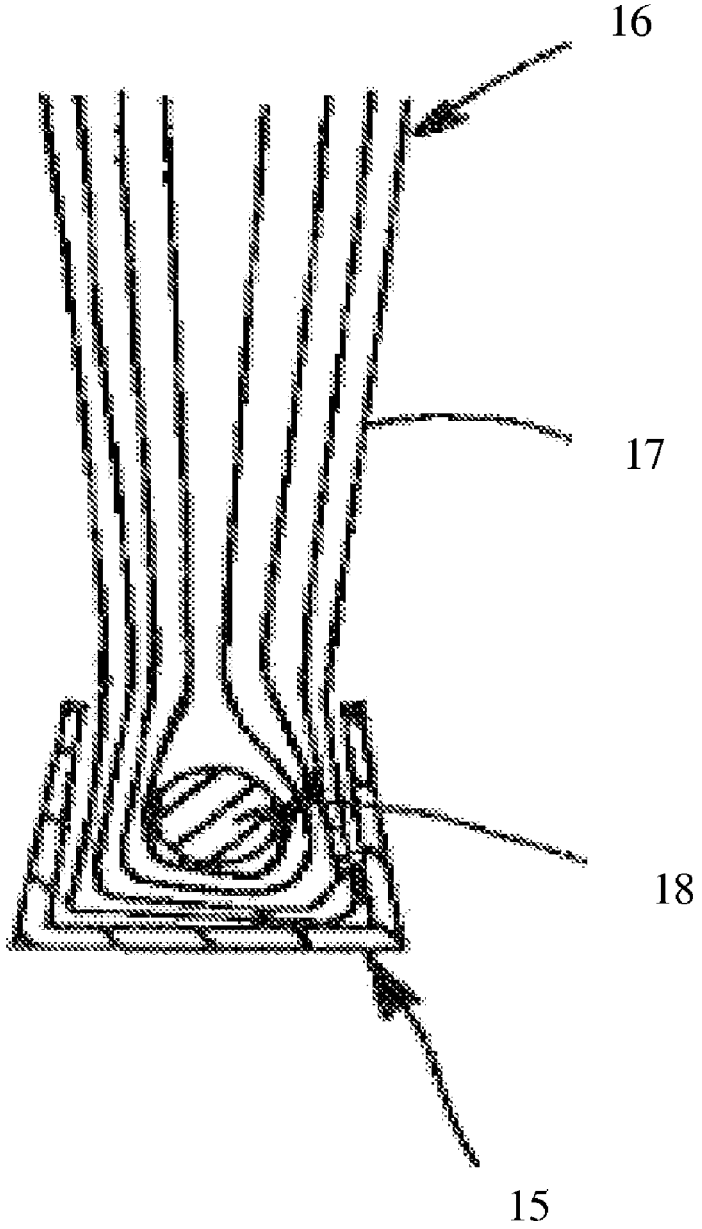
FIG. 6 shows a cross sectional view of the channel and bristles of FIG. 3.

As best shown in FIG. 2, each brush line 7 is disposed on the surface of the brush roll 9 with space 8 abutting each side of the brush line 7. Each brush lime 7 extends along the brush roll 9 substantially along the axial length of the casting roll 1.

In operation, the rotary drive 10 rotates the brush roll 9 such that the brush lines 7 are in contact with the surface of the casting rolls 1. The brush rolls 9 are rotated in an opposite direction as the direction of movement of the casting rolls 1. The actuator 14 urges the brush roll 9 toward the casting roll 1 to push the brush lines 7 against the surface of the casting roll 1.

In the illustrated example, the brush lines 7 are wrapped spirally around the barrel 6. As such, upon contact and rotation each brush line 7 engages the surface of the casting roll 1 proximate one end of the casting roll 1 and the point of engagement of the brush line 7 and the surface of the casting roll 1 moves axially along the surface of the casting roll 1 to proximate the other end of the casting roll 1.

As best shown in FIGS. 3-6, each brush roll 9 includes a barrel 6 with a number of rings, formed from channels with spaced apart bristles, e.g. lengths of round. Each ring includes spaced groups of bristles 16, formed for example from wires 17. The wires 17 are folded over a retaining wire 18 and crimped in a trace 15. Alternative, the groups of bristles 16 may be placed in the trace 15 and crimped in place.

In the illustrated example, the channels and bristles are wrapped around the barrel 6 in rings that are staggered manner such that the bristles 16 form spiral brush lines 7. Alternatively, the brush lines 7 may have other desired patters such as zigzags, waves, crisscrosses or W's or M's. The lines 7 may be 10 mm to 50 mm apart separated by open space of 2 mm to 45 mm. The brush lines 7 may be one line per 10 mm to 90 mm of axial length of brush roll 9.

The bristles 16 may be spaced equidistantly in a circumferential direction about a ring or may optionally be spaced in any desired relationship. In this example, when the rings are fitted and secured to the barrel 6 the bristles 16 are positioned relative to one another such that the bristles 16 from the brush lines 7 extending along the length of the casting rolls. The pattern and placement of the bristles 16 may result in the brush lines 7 forming a spiral, zigzag, wave, or crisscross array about the barrel 6.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. A method of casting metal strip comprising:

(a) assembling a pair of casting rolls laterally disposed to form a nip between them, (b) assembling a pair of brush rolls with one of each of the brush rolls associated with one of each of the casting rolls, each brush roll includes a plurality of rings staggered about the brush roll, wherein each ring includes spaced groups of bristles which form spaced apart brush lines in an array without any bristles between adjacent brush lines, (c) introducing molten metal to form a casting pool of molten metal supported on the casting rolls above the nip, and (d) counter rotating the casting rolls to deliver cast strip downwardly from the nip and rotating the brush rolls to clean the casting rolls.

2. The method as claimed in claim 1 where the brush lines form a spiral array along the brush roll.

3. The method as claimed in claim 1 where the bristles are regularly spaced apart in the rings.

4. The method as claimed in claim 1 where the bristles are irregularly spaced apart in the rings.

5. The method as claimed in claim 1 where the brush lines are in a zigzag array.

6. The method as claimed in claim 1 where the brush lines are in a wave array.

7. The method as claimed in claim 1 where the brush lines are in a crisscross array.

8. The method as claimed in claim 1 where the brush lines are between 10 to 50 mm apart and the brush lines are separated by between 2 mm to 45 mm of open space.

9. The method as claimed in claim 1 where brush lines are one line per 10 mm to 90 mm of axial length of brush roll.

10. A metal strip casting apparatus for casting metal strip comprising:

(a) a pair of casting rolls laterally disposed to form a nip between them; and (b) a pair of brush rolls with one of each of the brush rolls associated with one of each of the casting rolls, each brush roll includes a plurality of rings staggered about the brush roll, wherein each ring includes spaced groups of bristles which form spaced apart brush lines in an array without any bristles between adjacent brush lines.

11. The metal strip casting apparatus for casting metal strip as claimed in claim 8 where the brush lines form a spiral array about the brush roll.

12. The metal strip casting apparatus for casting metal strip as claimed in claim 8 where the bristles are regularly spaced apart in the ring.

13. The metal strip casting apparatus for casting metal strip as claimed in claim 8 where the bristles are irregularly spaced apart in the ring.

14. The metal strip casting apparatus for casting metal strip as claimed in claim 8 where the brush lines are in a zigzag array.

15. The metal strip casting apparatus for casting metal strip as claimed in claim 8 where the brush lines are in a wave array.

16. The metal strip casting apparatus for casting metal strip as claimed in claim 8 where the brush lines are in a crisscross array.

17. The metal strip casting apparatus for casting metal strip as claimed in claim 8 where the brush lines are between 10 to 50 mm apart and the brush lines are separated by between 2 mm to 45 mm of open space.

18. The metal strip casting apparatus for casting metal strip as claimed in claim 8 where brush lines are one line per 10 mm to 90 mm of axial length of brush roll.

* * * * *